US008033402B1

(12) United States Patent
Bevis

(10) Patent No.: US 8,033,402 B1
(45) Date of Patent: Oct. 11, 2011

(54) BOTTLE HOLDER

(76) Inventor: Jason Thomas Bevis, Irvine, CA (US)

( * ) Notice: Subject to any disclaimer, the term of this patent is extended or adjusted under 35 U.S.C. 154(b) by 354 days.

(21) Appl. No.: 12/125,867

(22) Filed: May 22, 2008

(51) Int. Cl.
*A47B 43/00* (2006.01)

(52) U.S. Cl. ..... 211/74

(58) Field of Classification Search ..... 211/74, 211/75, 60.1, 76, 77, 85.18, 13.1, 71.01; 248/311.2, 312; 206/446; D7/701–708, D7/603, 619, 621; D6/553, 570, 466–469
See application file for complete search history.

(56) References Cited

U.S. PATENT DOCUMENTS

| | | | | | |
|---|---|---|---|---|---|
| D252,004 | S | * | 6/1979 | Leventhal | D7/706 |
| 4,207,933 | A | * | 6/1980 | Howson | 141/106 |
| 4,700,849 | A | * | 10/1987 | Wagner | 211/41.2 |
| 4,795,038 | A | * | 1/1989 | Johnson | 211/74 |
| 4,938,369 | A | * | 7/1990 | Carilli | 211/74 |
| 5,025,936 | A | | 6/1991 | Lamoureaux | |
| 5,036,989 | A | * | 8/1991 | Carilli | 211/74 |
| 5,180,066 | A | * | 1/1993 | McArdle | 211/74 |
| 5,197,612 | A | * | 3/1993 | Thomson | 211/74 |
| 5,285,907 | A | * | 2/1994 | Franchere et al. | 211/74 |
| 5,743,438 | A | * | 4/1998 | Sokolnicki | 222/181.1 |
| D414,991 | S | * | 10/1999 | Brown | D7/701 |
| 6,234,325 | B1 | | 5/2001 | Higgins et al. | |
| 6,234,326 | B1 | | 5/2001 | Higgins et al. | |
| 6,502,705 | B1 | * | 1/2003 | Ziegler | 211/74 |
| 7,080,743 | B1 | | 7/2006 | Wolseth | |
| 7,195,125 | B1 | | 3/2007 | Wolseth | |
| 7,232,039 | B2 | * | 6/2007 | Doran | 220/23.88 |
| D602,314 | S | * | 10/2009 | Stravitz | D7/701 |
| 2002/0108917 | A1 | * | 8/2002 | Maruyama | 211/74 |
| 2005/0082242 | A1 | * | 4/2005 | Hurst | 211/71.01 |
| 2005/0269229 | A1 | * | 12/2005 | Lowry | 206/386 |
| 2007/0017884 | A1 | * | 1/2007 | Yang | 211/74 |
| 2007/0108144 | A1 | * | 5/2007 | Flick | 211/74 |
| 2007/0108145 | A1 | * | 5/2007 | Milardo et al. | 211/74 |
| 2008/0142459 | A1 | * | 6/2008 | Donnell et al. | 211/74 |
| 2009/0152222 | A1 | * | 6/2009 | Seldon | 211/74 |
| 2009/0289018 | A1 | * | 11/2009 | Yang | 211/74 |

* cited by examiner

*Primary Examiner* — Jennifer E. Novosad
(74) *Attorney, Agent, or Firm* — Clay McGurk; The Law Office of Clay McGurk

(57) ABSTRACT

A bottle holder is provided for holding wine bottles or other types of bottles in a vertical or horizontal position. The bottle holder can be mounted to a wall or underneath a cabinet in a kitchen. The bottle holder has a rectangular base with circular openings for holding the wine bottles by their necks. The feet of the bottle holder use a universal key hole mount for ease of installation. The bottle holder is made from one piece of material, preferably metal, and is durable, stable and non-corrosive.

18 Claims, 4 Drawing Sheets

FIG. 5
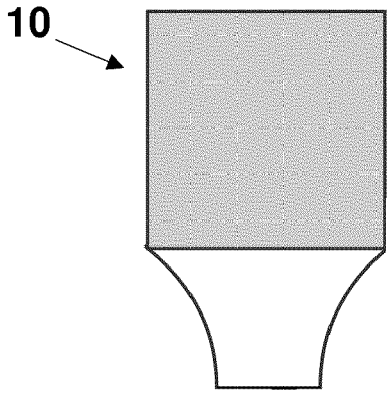
FIG. 6
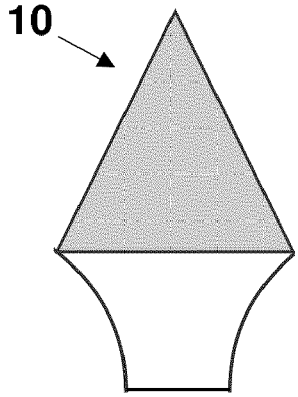
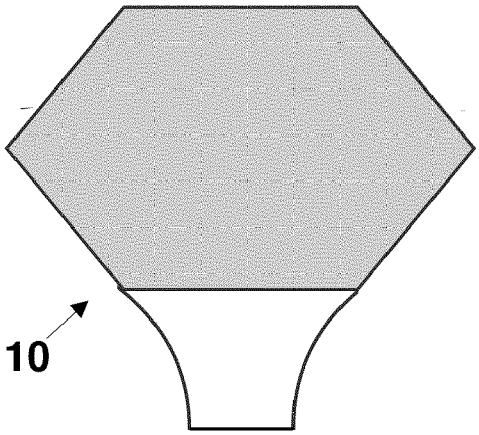
FIG. 7
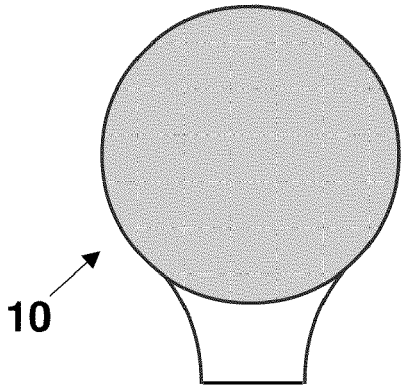
FIG. 8

BOTTLE HOLDER

BACKGROUND OF THE INVENTION

Some bottle holders are known for supporting wine bottles with the neck of each bottle extending through a single, corresponding opening in a column, where the column sits on the floor, a table, or counter. U.S. Pat. No. 3,901,389, for example, discloses such a rack which includes a vertical column with a number of holes formed in the column for receiving the necks of wine bottle. This patent also discloses a rack with an inclined flat member with spaced openings, so the wine bottles can be held in essentially a parallel relationship with the surface on which the rack is supported.

Some prior art bottle holders which support a bottle solely by its neck required multiple parts which had to be separately manufactured and subsequently assembled together. These parts usually consisted of a column which supported the bottle, and brackets or a base which attached to and supported the column. Because these bottle holders consisted of at least two pieces of material, they had a clumsy appearance. Where a single element had been used for a previous bottle holder, such in U.S. Pat. No. 4,496,124 for example, the bottle holding capacity was restricted to a single bottle and was not expandable to hold more than one bottle. In U.S. Pat. No. 5,180,066, it shows a wine bottle holder that is capable of holding more than one bottle in an almost horizontal position.

Prior art bottle holders were specifically made for sitting on a counter, a table, or a floor. Such prior art bottle holders when loaded with bottles occupied a large amount of space on the table-top or counter-top. They were neither designed nor made for mounting to a wall or underneath a cabinet. Therefore, there is a need for a bottle holder that can be easily mounted to a wall or underneath a cabinet. There is also a need for a bottle holder that is modular in its design so that additional holders can be stacked and mounted end-to-end.

SUMMARY OF THE INVENTION

In view of the foregoing disadvantages inherent in the prior art, the bottle holder of the present invention is modular in its design. Instead of occupying space on a counter, table, or the floor, the bottle holder is mounted either to a wall in the vertical position, or underneath a cabinet or counter in the horizontal position. Bottles are spaced evenly and are packed together compactly to get the most use from the space available. The bottle rack is manufactured from one piece of material and requires no assembly. It is sturdy and stable in its construction for holding multiple, unopened bottles.

Other and further aspects and features of the invention will be evident from reading the following detailed description of the preferred embodiments, which are intended to illustrate and, not limit the invention.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 5 shows a side perspective view of a square bottle holder.

FIG. 6 shows a side perspective view of a triangular bottle holder.

FIG. 7 shows a side perspective view of a polygonal bottle holder.

FIG. 8 shows a side perspective view of a cylindrical bottle holder.

DETAILED DESCRIPTION OF THE INVENTION

Figure 1:
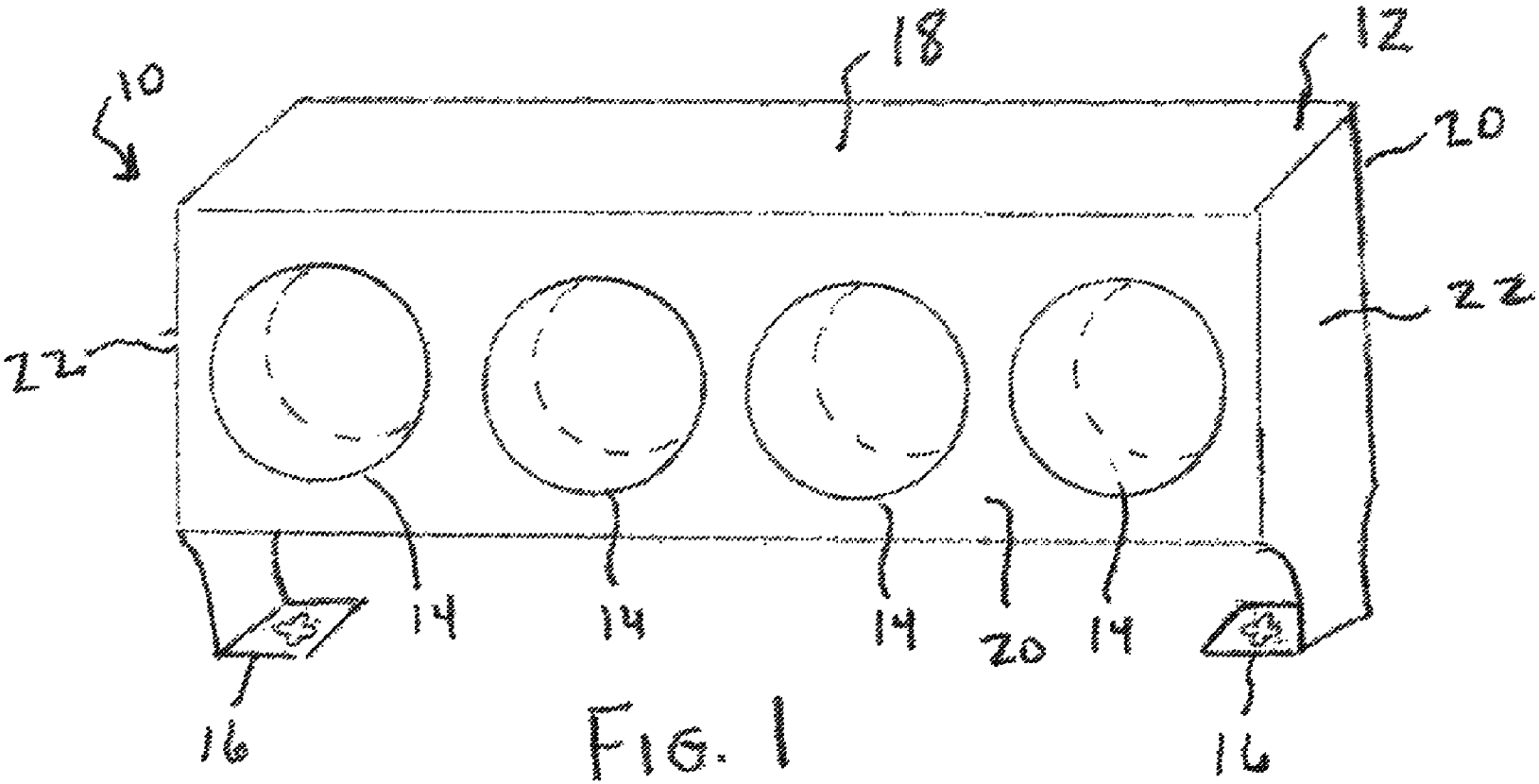
FIG. 1 shows a front perspective view of the bottle holder according to the present invention.

FIG. 1 shows a front perspective view of the bottle holder 10 according to the present invention. The holder 10 is preferably made from one piece of metal, such as aluminum, stainless steel, or steel. Other types of metals or materials such as copper, nickel, and plastic for example, could be used as well if they provide a durable, stable and sturdy base for holding multiple, unopened bottles. The metal thickness is preferably in the range of 8 gauge to 16 gauge. The metal finish of holder 10 could be painted, anodized, powder-coated, have a polished clear coat or left untouched. By having a one piece construction, holder 10 does not require any assembly. A bottle holder 10 that is constructed from metal is virtually unbreakable.

The bottle holder 10 has a rectangular base 12 with evenly spaced, circular openings 14, and two feet 16. The rectangular base 12 preferably has three sides: a top 18 (with no openings), two sides 20 with evenly spaced, circular openings 14, and two end sections 22 which are integrated with each of the feet 16. The circular openings on each side 20 are aligned and opposite the circular openings on the other side 20. Although there is no bottom piece of the rectangular base 12, in alternative embodiments, bottle holder 10 could have a bottom, thereby forming a rectangular enclosed box. In another alternative embodiment, a top portion 18 is not necessarily needed. If rectangular base 12 did not have a top 18, it would show the necks of the bottles inserted into holder 10.

It will be appreciated by those skilled in the art, that rectangular base 12 could have alternative designs and does not necessarily have to have a rectangular shape. Some example of alternative shapes are square, cylindrical, octagonal, triangular or polygonal, such as shown in FIGS. 5-8.

Figure 2:
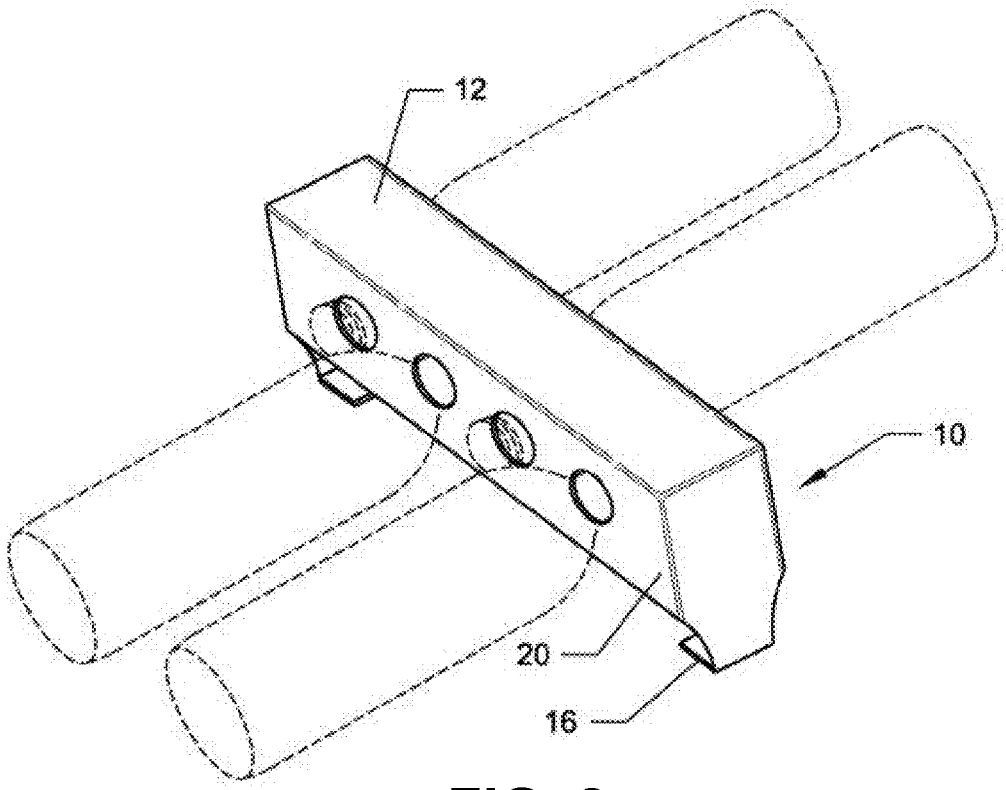
FIG. 2 shows an example of a bottle holder of the present invention holding four wine bottles.

The length of the rectangular base 12 has to have a minimum length for holding at least a single bottle (i.e., a bottle holder 10 with one opening per side 20). However, the length of the rectangular base 12 can be manufactured in a variety of different lengths and sizes to accommodate more than one bottle. The number of bottles that a particular holder 10 could hold would correspond to the number of openings 14 in each side 20. A neck of a wine bottle is fed through the circular opening 14 on one side 20, to a corresponding circular opening 14 aligned on the opposite side 20. The bottle holder 10 holds a bottle in the rectangular section 12 by its neck. For example, if four bottles were desired, each side 20 of rectangular base 12 would have four evenly spaced, circular openings 14. Two bottles would extend from one side 20, while the other two bottles would extend from the other side 20. The bottles would be staggered as shown in FIG. 2, and have the advantage of placing the configuration of the bottles into an economical, space saving design.

Each of the circular openings 14 in one of the sides 20 would be corresponding or opposite to another circular opening 14 in the opposite side 20. Each of the circular openings 14 has a preferable diameter ranging from 1 inch to 2 inches and are preferably spaced 1½ to 2½ inches apart, as measured from the center of each of the openings 14. This diameter and spacing are best suited for holding wine bottles having standard lengths and sizes that are commercially available for sale in stores and wineries. Such a structure of bottle holder 10 permits a person to place the wine bottles in any desired configuration. For example, a wine bottle could be placed in a corresponding set of first circular openings 14 in either direction.

Figure 3:
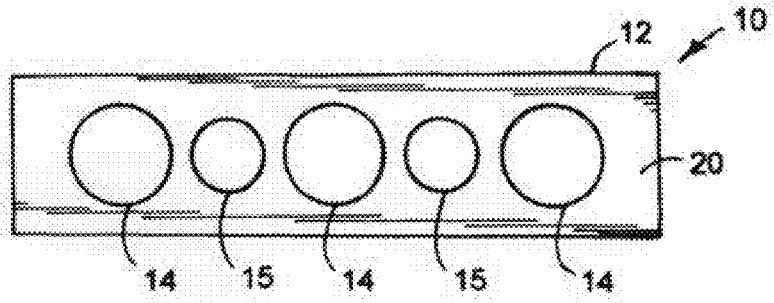
FIG. 3 shows an example of a bottle holder in an alternative embodiment having adjacent circular openings with varying sizes.

In alternative embodiments, the diameter and spacing between the openings 14 can be made smaller or larger to accommodate varying sizes of bottles, when such bottles are not the typical, standard wine bottles, but may be soda bottles, for example. Moreover, for the most compact alternative embodiment, the opening on one side could be one size 14, while the opening on the corresponding other side could be smaller 15, resulting in the circular openings 14, 15 shown in FIG. 3. However, this alternative embodiment would only allow the bottles to be inserted in one direction, not both directions as allowed by the preferred embodiment.

Figure 4:
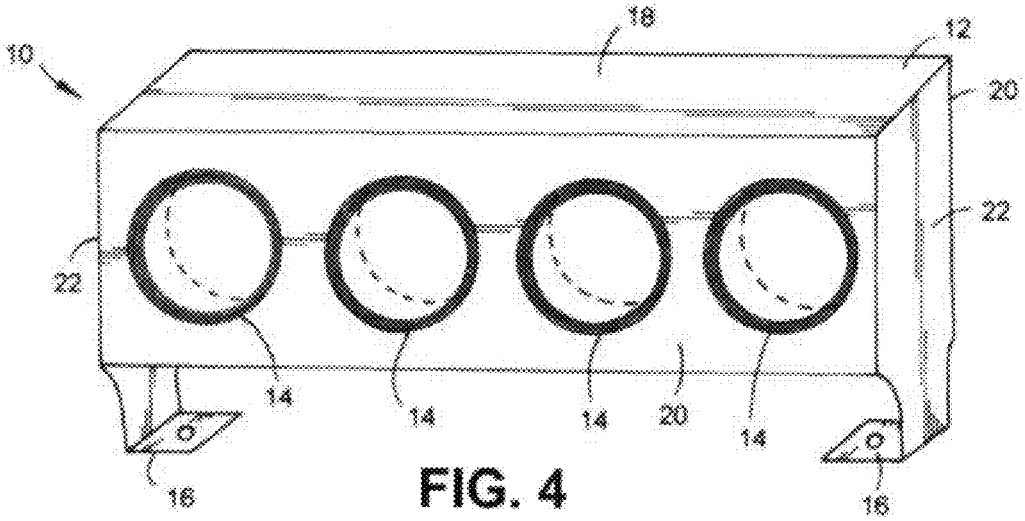
FIG. 4 shows an example of a bottle holder in an alternative embodiment.

In another embodiment, each opening could have a piece of material fit in the opening 14, such as shown in FIG. 4. Such suitable materials for example are rubber, plastic or other soft materials for securely hugging or holding a bottle in its inserted position in bottle holder 10. Moreover, if openings 14 were the same size, some inserts could be crafted to fit securely around the top portion of the neck of a bottle, while having a larger piece fit securely around the base of the neck of the bottle. These pliable inserts or pieces could be removed from the openings 14, or used in openings 14 for bottles having smaller necks than the neck of a standard wine bottle.

The end sections 22 of rectangular base 12 are preferably 2 to 3 inches wide, thus meaning that the distance between corresponding openings 14 on opposite sides 20 is the approximately the same distance apart. This width is preferable for holding the necks of wine bottles in opposite, circular openings 14 in a compact design. However, in alternative embodiments, the width of rectangular base 12 could be made smaller or larger depending on the size of the bottle the holder 10 is to accommodate.

Both end sections 22 of bottle holder 10 have a preferable length of 2½ inches to five inches. The smaller the length of end sections 22, the closer the bottle holder 10 and thus the bottles themselves would be to a wall or a surface. The ends sections 22 can be appropriately sized so that standard wine bottles would actually rest on the surface to which the bottle holder 10 is attached. Each of the feet 16 are formed, joined or integrated to a bottom portion of each of the end sections 22 as shown in FIG. 1. In the preferred embodiment and as shown in FIG. 1, each of the end sections 22 taper down to the feet 16. The feet 16 are formed at a right angle to the end section 22 or are parallel to the rectangular base 12. The feet 16 face inward toward the center of bottle holder 10. This structure of the feet 16 permits multiple bottle holders 10 to be stacked end-to-end or mounted next to one another, thus giving the bottle holder 10 a modular design. The feet 16 have an opening, preferably a universal key hole mount as shown in FIG. 1, so that bottle holder 10 can be attached to a surface using screws, nails or any other commercially available attaching means. The universal key hole mount makes the bottle holder 10 easy to install on a wall or other surface and allows the holder 10 to be mounted in either direction.

In alternative embodiments, the end sections 22 could be a rectangular shape that does not taper toward the feet 16, or end sections 22 could expand to a width larger than the width of the rectangular base 12. These embodiment give bottle holder 10 more stability when mounted to the wall than the tapered design. The feet 16 in this embodiment would be centered in a center portion of the end section 22, but would still protrude inward toward the center of the bottle holder 10 and be parallel to the rectangular base 12. In another alternative embodiment, instead of one foot 16 per side, there could be two or more feet 16, each having an opening shaped as a universal key hole mount. In yet another embodiment, rather than having the universal key hole mount, each foot 16 could have an circular opening for a screw, nail or other means for attaching it to the wall and/or counter.

Although emphasis has been placed on putting the bottle holder 10 in the vertical direction on a wall, such as the backsplash between the counter and cabinet for example, it can be appreciated by those skilled in the art that bottle holder 10 could be placed in a horizontal position, for example mounting the bottle holder 10 underneath the cabinets and over the counter-top. This space saving design frees up counter space and puts the bottles in a readily accessible position. The holder 10 could be placed in the vertical position on vertical surfaces, and in the horizontal position on horizontal surfaces. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Although particular embodiments of the present inventions have been shown and described, it will be understood that it is not intended to limit the present inventions to the preferred embodiments. For example, instead of holding wine bottles, the holder may additionally hold spice bottles, soda bottles, other types of bottles, pens, cigars, pencils, office supplies, tools or garden accessories. It will be obvious to those skilled in the art that various changes and modifications may be made without departing from the spirit and scope of the present inventions. Thus, the present inventions are intended to cover alternatives, modifications and equivalents, which may be included within the spirit and scope of the present inventions as defined herein.

What is claimed is:

1. A bottle holder, comprising:

a base having at least two sides and two end sections, where each of the two sides has at least one circular opening and each of the two end sections has a bottom surface, wherein each pair of circular openings is opposite and aligned to each other in the two sides, and wherein a neck of a bottle is capable of being circumferentially held by the pair of circular openings; and a plurality of feet, wherein each foot is attached to the bottom surface of each of the two end sections and protrudes inwardly toward the other foot.

2. The bottle holder as claimed in claim 1, wherein the bottle holder is formed from a single piece of material.

3. The bottle holder as claimed in claim 2, wherein the material is aluminum, steel, or stainless steel.

4. The bottle holder as claimed in claim 1, wherein the circular openings are evenly spaced on each side of the base.

5. The bottle holder as claimed in claim 1, further comprising material that fits within each of the circular openings.

6. The bottle holder as claimed in claim 5, wherein the material is rubber or plastic.

7. The bottle holder as claimed in claim 1, wherein each of the circular openings has the same diameter.

8. The bottle holder as claimed in claim 1, wherein each of the circular openings have different sizes on the sides opposite to each other.

9. The bottle holder as claimed in claim 1, wherein each of the feet has an opening in a shape of a universal key hole mount.

10. The bottle holder as claimed in claim 1, wherein each of the feet has a circular opening.

11. The bottle holder as claimed in claim 1, wherein each of the feet protrude toward a center of the base.

12. The bottle holder as claimed in claim 1, wherein the feet are configured to be attached to a vertical surface.

13. The bottle holder as claimed in claim 1, wherein the feet are configured to be attached to a horizontal surface.

14. The bottle holder as claimed in claim 1, wherein the base has a rectangular, square, triangular, cylindrical or polygonal shape.

15. The bottle holder as claimed in claim 1, wherein the bottle holder holds bottles by their necks in the circular openings.

16. A bottle holder, comprising:

a base having at least two sides and two end sections, where each of the two sides has at least one circular opening and each of the two end sections has a bottom surface, wherein each pair of circular openings is opposite and aligned to each other in the two sides, and one of the circular openings of the pair of circular openings is capable of circumferentially holding a portion of a neck of a bottle and the opposite, aligned circular opening of the pair of circular openings is capable of circumferentially holding a different portion of the neck of the bottle so that the bottle is held in a substantially perpendicular position to the circular openings;

a plurality of feet configured for attaching the bottle holder to a vertical wall, wherein each foot is attached to the bottom surface of each of the two end sections protrude protrudes inwardly toward the other foot.

17. The bottle holder as claimed in claim 16, wherein the base has a rectangular, square, triangular, cylindrical or polygonal shape.

18. A bottle holder, comprising:

a base having at least two sides and two end sections, where each of the two sides has at least one circular opening and each of the two end sections has a bottom surface, wherein each pair of circular openings is opposite and aligned to each other in the two sides, and each pair of circular openings is capable of holding a neck of a bottle at two different places along the neck so that the bottle is held in a substantially perpendicular position to the circular openings; and a plurality of feet, wherein each foot is attached to the bottom surface of each of the two end sections and protrudes inwardly toward the other foot.

* * * * *